US010139196B2

(12) United States Patent
Szlemko et al.

(10) Patent No.: US 10,139,196 B2
(45) Date of Patent: Nov. 27, 2018

(54) MARKSMAN LAUNCHER SYSTEM ARCHITECTURE

(71) Applicant: Raytheon Company, Waltham, MA (US)

(72) Inventors: Emile M. Szlemko, Vail, AZ (US); Huy Le, Tucson, AZ (US); Brian A. Gin, Tucson, AZ (US); Ryan P. Wahl, Tucson, AZ (US); Mary L. Kulbacki, Green Valley, AZ (US); Chad V. Anderson, Tucson, AZ (US); David P. Ueberschar, Marana, AZ (US)

(73) Assignee: RAYTHEON COMPANY, Waltham, MA (US)

( * ) Notice: Subject to any disclaimer, the term of this patent is extended or adjusted under 35 U.S.C. 154(b) by 115 days.

(21) Appl. No.: 15/264,992

(22) Filed: Sep. 14, 2016

(65) Prior Publication Data

US 2018/0128573 A1 May 10, 2018

(51) Int. Cl.

| | |
|---|---|
| ***G06F 19/00*** | (2018.01) |
| ***F41F 3/04*** | (2006.01) |
| ***B63G 1/00*** | (2006.01) |
| ***F41F 3/073*** | (2006.01) |

(52) U.S. Cl.

CPC ..... *F41F 3/04* (2013.01); *B63G 1/00* (2013.01); *F41F 3/073* (2013.01)

(58) Field of Classification Search

CPC ..... F41F 3/04; B63G 1/00
USPC ..... 235/400; 244/3.1, 3.3
See application file for complete search history.

(56) References Cited

U.S. PATENT DOCUMENTS

| | | | |
|---|---|---|---|
| 4,949,026 | A | 8/1990 | Mead |
| 5,737,500 | A | 4/1998 | Seraji et al. |
| 6,349,898 | B1 | 2/2002 | Leonard et al. |
| 6,995,539 | B1 | 2/2006 | Challoner |
| 7,032,493 | B2 | 4/2006 | Fowler |

(Continued)

FOREIGN PATENT DOCUMENTS

| | | | |
|---|---|---|---|
| EP | 0 932 014 | A2 | 1/1999 |
| WO | 2015166487 | A1 | 11/2015 |

OTHER PUBLICATIONS

International Search Report and Written Opinion for corresponding International Application No. PCT/US2017/023286 dated Jun. 9, 2017.

*Primary Examiner* — Karl D Frech
(74) *Attorney, Agent, or Firm* — Renner, Otto, Boisselle & Sklar, LLP

(57) ABSTRACT

An effector launching system includes an environment that has external components located within the environment. The effector launching system may include a modular controller located in the environment of an effector launching system and the external components may be located in the environment externally to the modular controller for executing an effector launching sequence. The modular controller may include a core processor module that is configured to execute a plurality of different effector launching sequences using the external components and a plurality of converting modules that each have an electro-mechanical interface and is connectable between the core processor module and one of the external components. The plurality of converting modules are configured to send and receive data with the core processor module and the plurality of external components.

20 Claims, 3 Drawing Sheets

(56) References Cited

U.S. PATENT DOCUMENTS

| | | | | |
|---|---|---|---|---|
| 7,348,747 | B1 | 3/2008 | Theobold et al. | |
| 7,410,125 | B2 | 8/2008 | Steele | |
| 7,910,867 | B1 * | 3/2011 | Edwards | F41G 7/007 235/400 |
| 8,468,924 | B2 | 6/2013 | Skurdal et al. | |
| 2006/0024056 | A1 * | 2/2006 | Erisman | H04L 49/254 398/45 |
| 2006/0219094 | A1 * | 10/2006 | Padan | B64D 7/06 89/37.16 |
| 2006/0284050 | A1 * | 12/2006 | Busse | G01J 1/4228 250/203.1 |
| 2011/0089237 | A1 | 4/2011 | Morocz | |
| 2017/0328678 | A1 * | 11/2017 | Burke | F41G 7/006 |

* cited by examiner

MARKSMAN LAUNCHER SYSTEM ARCHITECTURE

FIELD OF THE INVENTION

The invention relates to a system for launching an effector and more particularly, an effector launching system for a naval ship.

DESCRIPTION OF THE RELATED ART

Effector launching systems may be used in various defense applications. A marine vessel or naval ship is one example of a defense application that uses an effector launching system. More specifically, naval ships generally implement an above-deck launching system. Conventionally-used naval above-deck launching systems are point systems in that the systems are specifically configured to perform a specific mission with a launching sequence that utilizes a known effector having a predetermined shape and size. An example of a known effector may be a certain type of missile having a predetermined shape, size, and speed. However, the configuration of conventional launching systems may be limiting when an effector is to be upgraded or changed in lieu of a different type of effector or a modified effector, due to the launching system only being suitable for launching a single type of effector. As a consequence of limiting the type of effector that is suitable for use in the launching system, the non-adaptable launching system may effectively limit the variety and number of executable missions that may be performed by the naval ship.

SUMMARY OF THE INVENTION

A modular control system may be implemented in an effector launching system for enabling the system to be adaptable with different external components of the effector launching system. The external components of the effector launching system may include sensors, effector systems, global positioning systems, mounting platforms, or any other external components that may perform a function of the launching system. Effector systems may include launchers for launching any suitable type of effector such as munitions or missiles, counter measure devices, unmanned aerial vehicles (UAVs), or flares. The launching system is configured to perform a plurality of different launch sequences during which the external components perform functions such as effector launching, global positioning detection, and radar detection. The modular control system for controlling the external components includes a core processor module that is configured to initiate a launching sequence. The control system includes a plurality of converting modules that correspond to the external components and are in communication with the core processor module. The converting modules enable the core processor module to carry out different launching sequences by sending data between the core processor module and the external components. The converting modules is configured to convert signals or data from the core processor module to messages that are readable by the corresponding external component enabling the modular system to be reconfigurable for different types of effectors, sensors, launchers, launch platforms, and power sources. The following aspects of the invention may be combinable in any combination.

According to an aspect of the invention, an effector launching system includes an environment that has external components located within the environment. The effector launching system may include a modular controller located in the environment of an effector launching system and the external components may be located in the environment externally to the modular controller for executing an effector launching sequence. The modular controller may include a core processor module that is configured to execute a plurality of different effector launching sequences using the external components and a plurality of converting modules that each have an electro-mechanical interface and is connectable between the core processor module and one of the external components. The plurality of converting modules are configured to send and receive data with the core processor module and the plurality of external components.

According to an aspect of the invention, at least one of the plurality of converting modules may include an adapter for converting data from the core processor module to readable data for the external components.

According to an aspect of the invention, the adapter may be an effector adaptor that includes a mechanical support for holding an effector.

According to an aspect of the invention, at least one of the plurality of converting modules may be configured to transfer power from a power source to one of the external components.

According to an aspect of the invention, at least one of the plurality of converting modules may include a drive element for driving an effector launcher in a horizontal, vertical, or azimuthal direction.

According to an aspect of the invention, at least one of the plurality of converting modules may include a power converting module for transferring power from an external power source to other converting modules.

According to an aspect of the invention, at least one of the plurality of converting modules may include a testing module that is in communication with the core processor module to receive and send data to the core processor module corresponding to the efficiency of the external components. The testing module may be operable before or after the effector launching sequence.

According to an aspect of the invention, at least one of the plurality of converting modules may include a DC-to-DC converter or a transformer.

According to an aspect of the invention, the modular controller may include a housing in which the core processor module and the plurality of converting modules are self-contained.

According to an aspect of the invention, at least one of the plurality of converting modules may be removable from the housing.

According to an aspect of the invention, a launching system has surrounding environment and the launching system may include a plurality of external components located within the environment for executing an effector launching sequence, one of the external components being a launching device, a platform in which the launching device is deployed, and a modular controller for executing the effector launching sequence that is located within the environment of the launching system. The plurality of external components may be located externally to the modular controller. The modular controller may include a core processor module and a plurality of converting modules that each have an electro-mechanical interface and is connectable between the core processor module and one of the plurality of external components. The plurality of converting modules may be configured to send and receive data with the core processor module and the plurality of external components enabling the core processor module to execute a plurality of different effector launching sequences.

According to an aspect of the invention, at least one of the plurality of external components may be an effector or a sensor and at least one of the plurality of converting modules may include an adapter in communication with the effector or the sensor.

According to an aspect of the invention, the launching system may include a plurality of effectors that each have a different configuration, the plurality of converting modules enabling the core processor module to communicate with each of the plurality of effectors.

According to an aspect of the invention, at least one of the plurality of converting modules may include a drive element for driving the launcher in a horizontal, vertical, or azimuthal direction.

According to an aspect of the invention, the platform may be moveable.

According to an aspect of the invention, the launching system may include a housing in which the core processor module and the plurality of converting modules are contained. The plurality of external components may be disposed exteriorly relative to the housing.

According to an aspect of the invention, a method of controlling a launching system may be used for a launching system having a plurality of external components for executing a launching sequence. The method may include storing data corresponding to a plurality of predetermined launch sequences in a memory of a core processor module, wherein the launching system is reconfigurable for each of the plurality of predetermined launch sequences, selecting a predetermined launch sequence from the plurality of predetermined launch sequences, using a plurality of converting modules to communicate between the core processor module and the plurality of external components associated with the selected predetermined launch sequence, wherein each of the plurality of converting modules is associated with one of the plurality of external components, and executing the selected predetermined launch sequence.

According to an aspect of the invention, the method may further include using the plurality of converting modules to send data corresponding to the executed launch sequence to the core processor module.

According to an aspect of the invention, the method may further include updating the memory of the core processor module to store data corresponding to additional launch sequences.

According to an aspect of the invention, the method may further include using the core processor module and the plurality of converting modules to execute each of the plurality of launch sequences.

According to an aspect of the invention, the method may further include using the core processor module and the plurality of converting modules to execute each of the plurality of launch sequences.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

The principles described herein have application in defense applications, such as in marine vessels or any vehicle where space may be constrained. Examples of suitable marine vessels may include a fast attack craft, patrol boat or other marine vehicle. Examples of other suitable vehicles may include ground based or air based vehicles such as cars, tanks, armored personnel carriers, hovercraft, helicopters, and planes. More specifically, the effector launching system described herein may be implemented in a naval ship having an above-deck effector launching system. The effector launching system includes a modular controller with a plurality of converting modules that enables the effector launching system to adapt or re-configure itself for different mission sequences that may use different external components of the launching system as compared with other mission sequences. The effector launching system described herein may be a universal launching system suitable for any class of naval ship.

Figure 1:
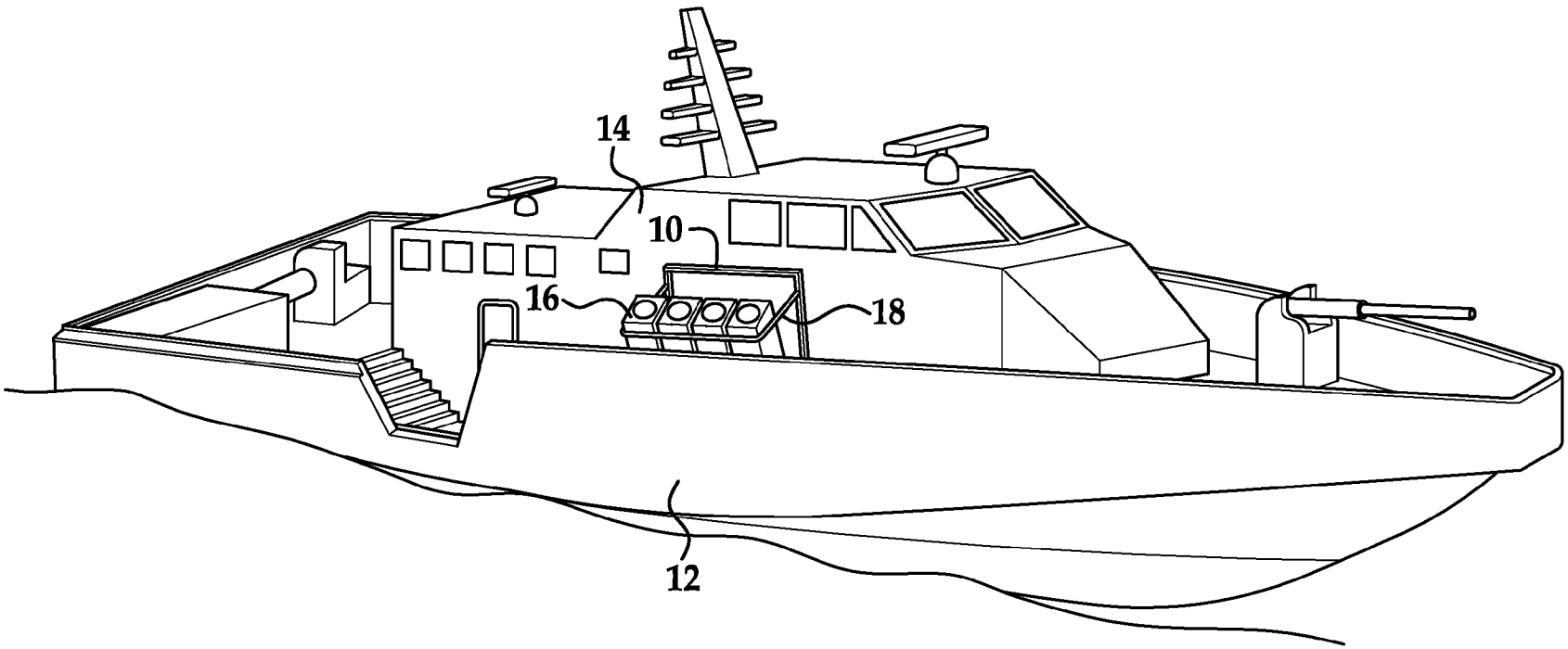
FIG. 1 is a schematic drawing of a vehicle having an effector launching system.

Referring now to FIG. 1, an effector launching system 10 may be configured for a vehicle, or naval vessel 12. The naval vessel 12 may include a vehicle surface 14 that is horizontal, vertical, or angled. The effector launching system 10 may be positioned on the vehicle surface 14. The effector launching system 10 may have a deployed position and a stowed position. The deployed position is shown in FIG. 1. The effector launching system 10 may include a plurality of effector launchers 16 that are housed in an effector launcher housing or platform 18. As shown in FIG. 1, the platform 18 may have a vertical orientation. In another exemplary configuration, the platform 18 may be mounted on a horizontal or angled portion of the naval vessel 12 such that the platform 18 may be horizontal or angled. The platform 18 may be moveable or re-orientable in response to detection of a target in a particular direction.

Figure 2:
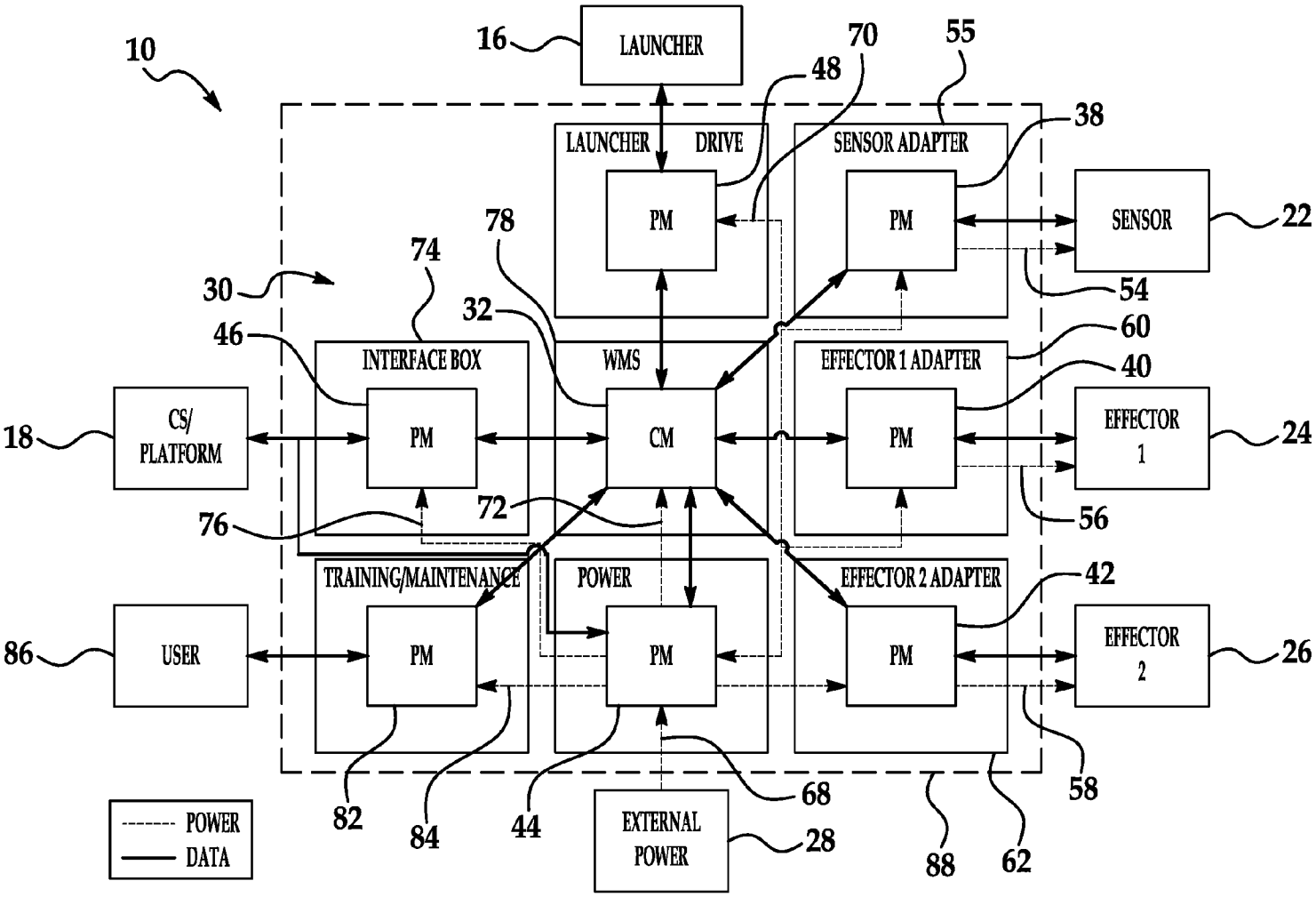
FIG. 2 is a schematic drawing showing an effector launching system having a plurality of external components, a core processor module, and a plurality of converting modules in communication between the core processor module and the plurality of external components.
Figure 3:
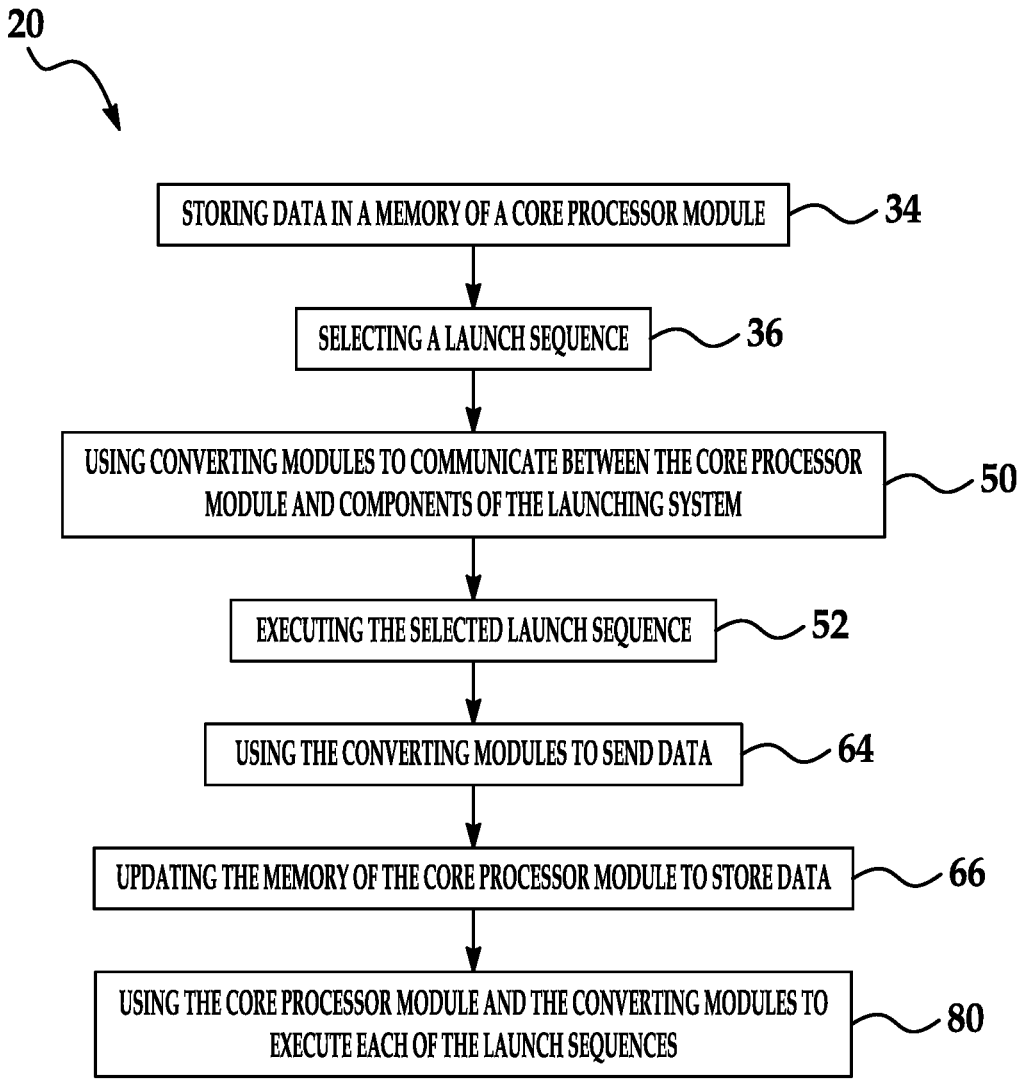
FIG. 3 is a flow chart showing a method of controlling an effector launching system.

Referring in addition to FIGS. 2 and 3, schematic drawings of the effector launching system 10 and a method 20 for controlling the effector launching system 10 are shown. The effector launching system 10 may include a plurality of external components associated with different functions of the effector launching system 10, such as the effector launcher 16 and the effector launcher platform 18. The external components of the effector launching system may include sensors, effector systems, global positioning systems, mounting platforms, ship self-defense systems, or any other external components that may perform a function of the launching system. The launching system is configured to perform a plurality of different launch sequences during which the external components perform functions such as effector launching, effector or missile interception, global positioning detection, radar detection, and detection and tracking of potential threats.

External components of the effector launching system 10 may include at least one sensor 22, at least one effector or a plurality of effectors 24, 26, and an external power supply or source 28. Examples of types of effectors that may be launched via the effector launcher 16 include missiles, counter measure devices, flares, unmanned air vehicles (UAVs), and non-lethal effectors. Other types of effectors may also be suitable and the effector launching system 10 may include a plurality of effectors 24, 26. The effectors 24, 26 may each be a different type of effector or the effectors 24, 26 may be the same type but have different specifications, such as size and shape. For example, each of the plurality of effectors 24, 26 may be a missile having a different size and/or shape. The variable selection of effectors 24, 26 is advantageous in that the vehicle or naval vessel 12 may have a broader capability for differing missions.

The effector launching system 10 includes a modular controller 30 for operating the effector launching system 10. The effector launching system 10 generally includes an environment that includes the modular controller 30 and the external components. The external components may be located externally to the modular controller 30 within the environment of the effector launching system 10. In an exemplary configuration, at least one of the external components may be located within the modular controller 30. For example, a sensor may be positioned within the modular controller 30.

In an exemplary configuration, the modular controller 30 described herein may be implemented in a launching system on a naval vessel having a plurality of associated external components. The external components may be removed, upgraded, or replaced and the modular controller 30 may be adaptable to any new or replacement components. In still another exemplary configuration, the modular controller 30 described herein may be initially implemented in a first naval vessel having an associated launching system and external components. The modular controller 30 may be removable from the launching system of the first naval vessel and implemented in a second naval vessel having an associated launching system and external components. After being implemented in the second naval vessel, the modular controller 30 may still be implemented in additional naval vessels having different launching systems and external components. The modular controller 30 may be adaptable for any suitable naval vessel and associated launching system.

As shown in FIG. 2, the modular controller 30 may include a primary computer or a core processor module 32 that is configured to operate each of the plurality of external components. The external components may be located externally relative to a housing of the modular controller 30. As shown in FIG. 3, step 34 of the method 20 may include storing data corresponding to a plurality of predetermined launch sequences in a memory of the core processor module 32. Each predetermined launch sequence may implement different functions of the effector launching system 10 and use different external components of the effector launching system 10. The core processor module 32 may include the memory for storing the predetermined launch sequences that enable a variety of missions to be performed by the effector launching system 10.

After storing data corresponding to the launch sequences, step 36 of the method 20 may include selecting a launch sequence from the stored launch sequences in the memory of the core processor module 32. The launch sequence may be selected by a user or the launch sequence may be automated by the core processor module 32 in response to sensors. For example, the launch sequence may be initiated in response to a detected threat. After the launch sequence is selected, the core processor module 32 may communicate with the external components of the launching system 10 for executing the launch sequence.

The modular controller 30 may include a plurality of converting modules 38, 40, 42, 44, 46, 48 associated with the plurality of external components that are connectable between the core processor module 32 and the plurality of external components. After the launch sequence is selected, step 50 of the method 20 may include using the converting modules to communicate between the core processor module 32 and the external components of the effector launching system 10. The converting modules 38, 40, 42, 44, 46, 48 may be electrically connected between the core processor module 32 and the plurality of external components. The core processor module 32 may receive data and send data to the plurality of converting modules 38, 40, 42, 44, 46, 48. The core processor module 32 may be configured to send data to fewer than all of the external components of the launch system 10 enabling varying launch sequences to be performed by the launch system.

The converting modules 38, 40, 42, 44, 46, 48 may also be configured to receive and send data to a corresponding one of the plurality of external components, such as the sensor 22 or the effectors 24, 26. Each of the converting modules 38, 40, 42, 44, 46, 48 may include electrical and mechanical external components connected between the modules for transferring power and data between the modules and between the modules and the external components of the effector launching system 10. The connections may include cables, power and sockets, power and data ports and the connections between the sockets and ports may be sealed. The converting modules 38, 40, 42, 44, 46, 48 may be configured to convert signals from the core processor module 32 into messages that are readable by the external components. The modular controller 30 may implement Ethernet using the core processor module 32 and the plurality of converting modules 38, 40, 42, 44, 46, 48 that are each connected to the core processor module 32. The converting modules 38, 40, 42, 44, 46, 48 may include a DC-to-DC converter or a transformer. After the converting modules 38, 40, 42, 44, 46, 48 send data pertaining to the selected launch sequence to the corresponding external components, step 52 of the method 20 may include executing the selected launch sequence.

At least one of the plurality of converting modules may include a sensor adaptor 38 connected between the at least one sensor 22 and the core processor module 32. The sensor adaptor 38 may be electrically connected with the sensor 22 via an electrical connector 54 such that the sensor adaptor 38 may transfer power to the sensor 22. The sensor adaptor 38 may include an electro-mechanical interface between the sensor 22 and the core processor module 32. The sensor adaptor 38 may include a housing 55 to mechanically house and protect the sensor 22. The housing 55 may provide a data link or interface between a data and power port to the sensor 22 to facilitate the flow of target information, location information of the effector prior to launch, launch instructions, or any suitable information. Any suitable electronics housing may be used. The sensor adaptor 38 may be configured to electronically convert the power and signals from the core processor module 32 to any specific requirement of the sensor 22. The sensor 22 may have any suitable capability for the naval vessel 12 and the sensor 22 may be any suitable type of sensor. An example of a capability of the sensor may include threat detection or target detection, such that the sensor 22 may be configured to detect the infrared light of a target, relative motion of a target, or the ultraviolet shadow of the target. The at least one sensor 22 may include a radio-frequency sensor for measuring a range of the target or an electro-optical sensor for measuring an angle of the target. The at least one sensor 22 may include a radar or a laser designator for designating a target. The housing 55 may include any suitable mounting device for the laser designator.

At least one of the plurality of converting modules may include at least one adaptor or a plurality of adaptors 40, 42 connected between at least one effector of a plurality of effectors 24, 26 and the core processor module 32. The effector adaptors 40, 42 may be electrically connected with the effectors 24, 26 via an electrical connector 56, 58 such that the effector adaptors 40, 42 may transfer power to the effectors 24, 26. Similarly to the sensor adaptor 38, the effector adaptors 40, 42 may include an electro-mechanical interface between the effectors 24, 26 and the core processor module 32. The effector adaptors 40, 42 may include housings 60, 62 that mechanically house and protect the effectors 24, 26. The housings 60, 62 may provide a data link or interface between a data and power port to the effectors 24, 26 to facilitate the flow of target information, location information of the effector prior to launch, launch instructions, or any suitable information. Any suitable electronics housing may be used. The effector adaptors 40, 42 may be configured to electronically convert power and signals from the core processor module 32 to any specific requirement of the effectors 24, 26. Examples of possible requirements for the effectors 24, 26 may include exhaust management, robustness, lethality, guidance, accuracy, and navigation.

Each of the plurality of effector adaptors 40, 42 may be associated with one of the plurality of different effectors 24, 26. Using the plurality of effector adaptors is advantageous in that the effector adaptors may be replaceable and different types of effectors may be used in the effector launching system 10. The effector launching system 10 is not configured for a specific type of effector and the system may be adaptable for future effectors. Both the at least one sensor adaptor 38 and the effector adaptors 40, 42 may also be configured to receive data from the corresponding sensor 22 or effectors 24, 26. After the launch sequence has been executed or during the execution of the launch sequence, step 64 of the method 20 may include using the converting modules to send data to the core processor module 32. After the data is sent to the core processor module 32, step 66 of the method 20 may include updating the memory of the core processor module 32 to store data pertaining to the executed launch sequence or to store additional launch sequences.

At least one of the plurality of converting modules may include a power converting module 44. The power converting module 44 may be electrically connected with the external power source 28 via an electrical connector 68 and the external power source 28 may supply power to the plurality of converting modules. The power converting module 44 may be electrically connected with the sensor adaptor 38 and the effector adaptors 40, 42 via an electrical connector 70. The power converting module 44 may also be electrically connected to the core processor module 32 via an electrical connector 72 and the external power source 28 may supply power to the core processor module 32. The power converting module 44 may be configured to convert power from the platform 18 into power that may be used to launch the effectors 24, 26. The power converting module 44 may also be configured to convert power supplied by the external power source 28 as suitable for operating the effector launching system 10, enabling different sources of power to be used. For example, a power supply may run at around 120 volts, 230 volts, or 240 volts depending on the country where the power is supplied. The power converting module 44 may be configured to receive data and send data to the core processor module 32 and the platform 18.

The plurality of converting modules may include an interface module 46 that is in communication between the core processor module 32 and the platform 18. The interface module 46 is configured to perform signal conversions between the external components, such as the sensor 22 or the effectors 24, 26, and the core processor module 32 such that the core processor module 32 can communicate with the external components of the effector launching system 10. The interface module 46 may further include a user interface 74 and a user may be able to select a specific function or mission sequence. The core processor module 32 may be configured to execute the function or mission sequence via the interface module 46 with the external components. The interface module 46 may be electrically connected to the power converting module 44 via an electrical connector 76 and the power converting module 44 may be configured to supply power from the external power source 28 to the interface module 46.

The plurality of converting modules or the interface module 46 may include a weapon management system 78. The weapon management system 78 may be configured to manage the plurality of effectors 24, 26 contained within the effector launching system 10. The weapon management system 78 may be in communication with each effector housing 60, 62 for providing messaging between the core processor module 32 and the effectors 24, 26. The weapon management system 78 may also be configured to send data regarding the status of the effectors 24, 26 and receive commands from the core processor module 32 or the platform 18.

In an exemplary configuration of the modular controller 30, at least one of the plurality of converting modules may be a launcher drive module 48 in communication between the core processor module 32 and the effector launcher 16. The launcher drive module 48 may be used to steer the effector launcher 16 in a specific direction, such as in a direction of a predetermined target. The power converting module 44 may be electrically connected to the external power source 28 and the launcher drive module 48 via the electrical connector 70. The effector launcher 16 may be motor driven and the launcher drive module 48 may include at least one motor or sensor. The effector launcher 16 may include a flare effector launcher or a UAV or counter measures effector. The launcher drive module 48 may include a positioning system for orienting the effector launcher 16. Using the launcher drive module 48 as one of the converting modules may be advantageous in that the launcher drive module 48 may enable the effector launcher 16 to be a vertical, horizontal, or azimuth launcher as opposed to conventionally-used launchers that may only be configured for one type of launching. The launcher drive module 48 may enable different types of effector launchers 16 to be implemented on the naval vessel 12.

The configuration of the converting modules may also be dependent on the configuration of the launcher housing or platform 18 in which the effector launcher 16 may be deployed. The platform 18 may include a type of ship or a concrete pad. The platform 18 may have any suitable size and the effector launching system 10 may enable the platform to be smaller relative to conventionally-used launching systems. The effector launchers 16 may be removably positioned within the platform 18. In the configuration of FIG. 1, the effector launcher housing 18 has a fold-down configuration, such that the effector launchers 16 may be in a stowed position within the vehicle surface or wall 14 of the naval vessel 12 or in a deployed position defined by the effector launchers 16 being unfolded from the wall 14. In a configuration where the effector launcher 16 is fixed, the converting modules may not use a launcher drive module 48 for driving the effector launcher 16.

Using the core processor module 32 and the plurality of converting modules described herein, the method 20 of controlling the launching system 10 may include step 80 of executing each of the launch sequences stored in the memory of the core processor module 32. Each of the plurality of launch sequences may be executed sequentially or at different times and the core processor module 32 and the converting modules may be repeatedly updated so that the launching system 10 may be adapted to run future launch sequences using different external components for the launching system 10.

When the effector launching system 10 is not in operation, the converting modules may further include a training module 82 that may be in communication with the core processor module 32 and may be electrically connected to the power converting module 44 via an electrical connector 84 such that the external power source 28 may supply power to the training module 82 when a user 86 operates the training module 82. The training module 82 may be operated by the user 86 for testing the effector launching system 10 prior to executing a mission sequence or after executing a mission sequence. The training module 82 may be configured to receive data from the core processor module 32 regarding predetermined performance parameters of the effector launching system 10. The core processor module 32 may receive data from the at least one sensor 22 and the at least one sensor 22 may be configured to detect various performance characteristics of the effectors 24, 26, effector launcher 16, the external power source 28, the plurality of converting modules, and any other input or output external components of the effector launching system 10. Using the data received from the core processor module 32, the training module 82 may include a computer or processor to calculate the efficiency of the effector launching system 10.

After calculating the efficiency of the effector launching system 10, the training module 82 may send data regarding the efficiency to the core processor module 32, such that the core processor module 32 and the plurality of converting modules may adjust various performance parameters of the effector launching system 10. Examples of various performance parameters may include the amount of power being supplied by the external power source 28, the position of the effectors 24, 26 and the effector launcher 16, and the position of the at least one sensor 22. Many other performance parameters may be adjusted by the core processor module 32 in response to the calculations performed by the training module 82. The training module 82 may also be configured to output performance data to the user 86.

As shown schematically in FIG. 2, the modular controller 30 may be self-contained in a housing 88 implemented on or in the naval vessel 12 shown in FIG. 1. The housing 88 may include a single housing. FIG. 2 shows a plurality of converting modules and external components, but more or fewer converting modules and external components may be used with the modular controller 30. The housing 88 may be a box-shaped container or an enclosure have any suitable shape to contain and store the external components of the modular controller 30 within the vehicle. The housing 88 may contain at least the core processor module 32 and the plurality of converting modules 38, 40, 42, 44, 46, 48. In a configuration where the converting modules are replaceable, the housing 88 may include a feature enabling the converting modules to be accessible so that the converting modules may be removed from the housing 88 or inserted into the housing 88. The modular controller 30 and housing 88 may be configurable in a variety of different naval vessels. In still another configuration, the housing 88 and the modular controller 30 may also be removable or detachable from the launching system and the associated external components of a first naval vessel, such that the modular controller 30 may be implemented in a second naval vessel having a different launching system with different external components relative to the first naval vessel.

The modular controller 30 may be implemented in a plurality of different naval vessels or in a plurality of different launch systems. In a first example, the modular controller 30 may be implemented initially in a first naval vessel having a launching system with a fixed vertical launching system for launching a first type of missile. The launching system may have sensors associated with the fixed vertical launching system for detecting a target. The corresponding launch sequence may be selected and carried out by the modular controller 30. After the selected launch sequence has been performed, the modular controller 30 may be removed from the first naval vessel and the launching system of the first naval vessel and implemented in a second naval vessel having a different launching system as compared with the first naval vessel. For example, the external components of the launching system of the second naval vessel may include different sensors and a horizontal launching system that is configured to launch a second type of missile. Advantageously, the modular controller 30 may be adaptable to enable compatibility between the core processor module that has the executable launch sequences stored with the different external components such that the modular controller 30 may be used to run a different launch sequence on the second naval vessel. The core processor module may also be updateable so that any new launch sequence or new type of external component, such as a new type of munition, may be configurable with the modular controller.

In a second example, the modular controller 30 may remain on a single naval vessel and be adaptable with different launching systems that may be implemented on the naval vessel. For example, a first launching system may include a fixed vertical launching system for launching a first type of missile. After the launch sequence is performed, the first launching system may be replaced by a second launching system. The second launching system may not include a launcher and may instead include a missile interception device such that the naval vessel may act in ship self-defense as opposed to missile launching in the first launching system. A converting module of the modular controller 30 may be associated with each external component of the launching systems and when a new external component is brought aboard the naval vessel, the converting modules may be connected to the modular controller to transmit information between the core processor module and the new external component.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (external components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A modular controller located in an environment of an effector launching system that has external components located in the environment externally to the modular controller for executing an effector launching sequence, wherein the external components include any of an effector, a sensor, an effector launcher, a mounting platform, or a power source, the modular controller comprising:

a core processor module that is configured to execute a plurality of different effector launching sequences using the external components; and a plurality of converting modules that each have an electro-mechanical interface and is connectable between the core processor module and one of the external components, wherein the electro-mechanical interface includes both an adaptive mechanical interface and an electrical connection between the core processor module and a corresponding one of the external components, wherein the plurality of converting modules are configured to send and receive data with the core processor module and the plurality of external components.

2. The modular controller of claim 1, wherein at least one of the plurality of converting modules includes an adapter for converting data from the core processor module to readable data for the external components.

3. The modular controller of claim 2, wherein the adapter is an effector adaptor that includes a mechanical support for holding the effector.

4. The modular controller of claim 2, wherein at least one of the plurality of converting modules is configured to transfer power from the power source to one of the external components.

5. The modular controller of claim 1, wherein at least one of the plurality of converting modules includes a drive element for driving the effector launcher in a horizontal, vertical, or azimuthal direction.

6. The modular controller of claim 1, wherein at least one of the plurality of converting modules includes a power converting module for transferring power from the power source to other converting modules.

7. The modular controller of claim 1, wherein at least one of the plurality of converting modules includes a testing module that is in communication with the core processor module to receive and send data to the core processor module corresponding to efficiency of the external components, the testing module being operable before or after the effector launching sequence.

8. The modular controller of claim 1, wherein at least one of the plurality of converting modules includes a DC-to-DC converter or a transformer.

9. The modular controller of claim 1 further comprising a housing in which the core processor module and the plurality of converting modules are self-contained.

10. The modular controller of claim 9, wherein at least one of the plurality of converting modules is removable from the housing.

11. A launching system having a surrounding environment, the launching system comprising:

a plurality of external components located within the environment for executing an effector launching sequence, wherein the external components include a a launching device, a platform in which the launching device is deployed, and at least one effector or a sensor; and a modular controller for executing the effector launching sequence that is located within the environment of the launching system, the plurality of external components being located externally to the modular controller, the modular controller including a core processor module and a plurality of converting modules that each have an electro-mechanical interface, wherein the electro-mechanical interface includes both an adaptive mechanical interface and an electrical connection between the core processor module and one of the plurality of external components, the plurality of converting modules being configured to send and receive data with the core processor module and the plurality of external components enabling the core processor module to execute a plurality of different effector launching sequences.

12. The launching system of claim 11, wherein at least one of the plurality of converting modules includes an adapter in communication with the at least one effector or the sensor.

13. The launching system of claim 12, wherein the launching system includes a plurality of effectors that each have a different configuration, the plurality of converting modules enabling the core processor module to communicate with each of the plurality of effectors.

14. The launching system of claim 11, wherein at least one of the plurality of converting modules includes a drive element for driving the launching device in a horizontal, vertical, or azimuthal direction.

15. The launching system of claim 14, wherein the platform is moveable.

16. The launching system of claim 11, wherein the launching system includes a housing in which the core processor module and the plurality of converting modules are contained, the plurality of external components being disposed exteriorly relative to the housing.

17. A method of controlling a launching system having a plurality of external components that includes at least two of an effector, a sensor, an effector launcher, a mounting platform, or a power source for executing a launching sequence, the method comprising:

storing data corresponding to a plurality of predetermined launch sequences in a memory of a core processor module, wherein the launching system is reconfigurable for each of the plurality of predetermined launch sequences;

selecting a predetermined launch sequence from the plurality of predetermined launch sequences;

using a plurality of converting modules to communicate between the core processor module and the plurality of external components associated with the selected predetermined launch sequence, wherein each of the plurality of converting modules has an adaptive mechanical interface and an electrical connection between the core processor module and a corresponding one of the external components; and executing the selected predetermined launch sequence.

18. The method of claim 17 further comprising using the plurality of converting modules to send data corresponding to the executed launch sequence to the core processor module.

19. The method of claim 17 further comprising updating the memory of the core processor module to store data corresponding to additional launch sequences.

20. The method of claim 17 further comprising using the core processor module and the plurality of converting modules to execute each of the plurality of launch sequences.

* * * * *